US005580476A

United States Patent [19]

Dam et al.

[11] Patent Number: 5,580,476

[45] Date of Patent: Dec. 3, 1996

[54] COMBINATION CATALYST WIRE WRAPPED A GLOW PLUG

[75] Inventors: Chuong Q. Dam; Kent A. Koshkarian; Martin L. Willi, all of Peoria, Ill.

[73] Assignee: Caterpillar Inc., Peoria, Ill.

[21] Appl. No.: 493,029

[22] Filed: Jun. 21, 1995

[51] Int. Cl.[6] ..... F23Q 7/00

[52] U.S. Cl. ..... 219/270; 123/145 A

[58] Field of Search ..... 219/270, 267, 219/260; 123/145 A, 145 R; 361/264–266

[56] References Cited

U.S. PATENT DOCUMENTS

| | | | |
|---|---|---|---|
| 4,852,530 | 8/1989 | John | 123/145 A |
| 4,896,636 | 1/1990 | Pfefferle | 123/145 A |
| 5,146,881 | 9/1992 | Pfefferle | 123/145 A |

FOREIGN PATENT DOCUMENTS

| | | |
|---|---|---|
| 55-143326 | 11/1980 | Japan . |
| 57-204729 | 12/1982 | Japan . |
| 58-217778 | 12/1983 | Japan . |
| 59-66618 | 4/1984 | Japan . |
| 59-167635 | 9/1984 | Japan . |

*Primary Examiner*—John A. Jeffery
*Attorney, Agent, or Firm*—Pankaj M. Khosla; Frank L. Hart

[57] ABSTRACT

A glow plug has a heating element having a tip formed of a preselected material includes a catalyst wire wrapped about and in intimate contact with the preselected material of the glow plug. The catalyst is formed of one of the platinum group metals, transition metals and combinations thereof and is in the form a wire with a diameter of 0.008 inches. The catalyst is free of charge carrying connection to a power source.

5 Claims, 2 Drawing Sheets

COMBINATION CATALYST WIRE WRAPPED A GLOW PLUG

TECHNICAL FIELD

The present invention relates to glow plugs for an internal combustion engine.

BACKGROUND ART

Glow plugs are well known in the art and are of various construction with a multiplicity of different materials. Examples of such glow plugs are found in U.S. Pat. No. 4,896,636, filed Feb. 17, 1989, and issued to W. C. Pfefferle on Jan. 30, 1990 and U.S. Pat. No. 5,146,881, filed Feb. 15, 1990, and issued as a continuation in part to W. C. Pfefferle.

One of the problems with glow plugs of internal combustion engines is forming a glow plug in a construction and with materials that will have relatively long life in their operational environment. This operational environment also generates additional problems when alternate fuels such as natural gas, methanol, propane and water emulsion are used to operate the engine.

The present invention is directed to overcome one or more of the problems as set forth above.

DISCLOSURE OF THE INVENTION

A glow plug has a heating element and a tip with said tip formed of a preselected material. A catalyst is wrapped about and in intimate contact with the preselected material of the glow plug. The catalyst is one of the platinum group metals, transition metals and combination thereof and is in the form of one of wire, gauge and sheath. The catalyst wire is free of charge carrying connection to a power source.

BEST MODE FOR CARRYING OUT THE INVENTION

Figure 1:
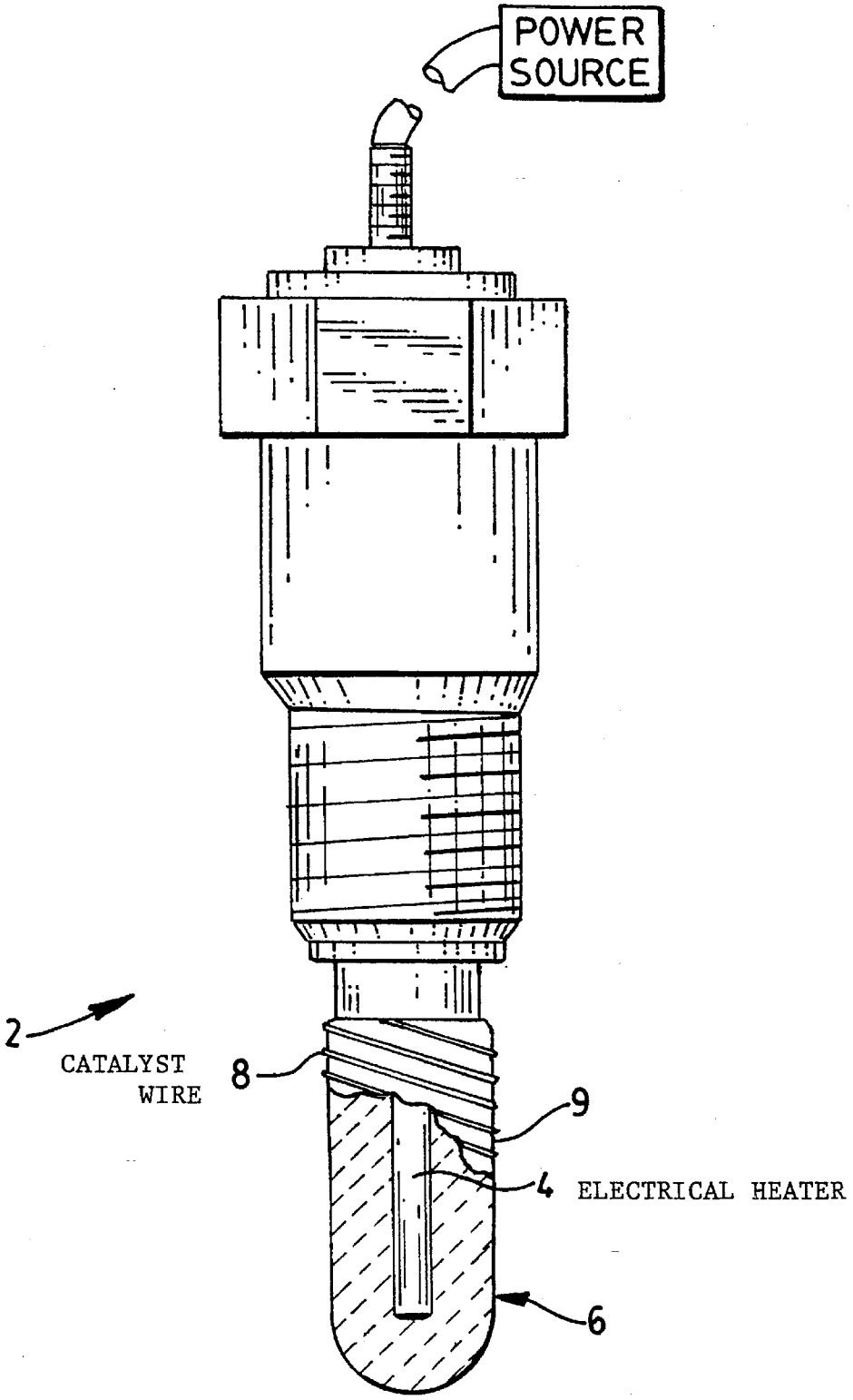
FIG. 1 is a diagrammatic view is partial section of a glow plug of this invention.
Figure 2:
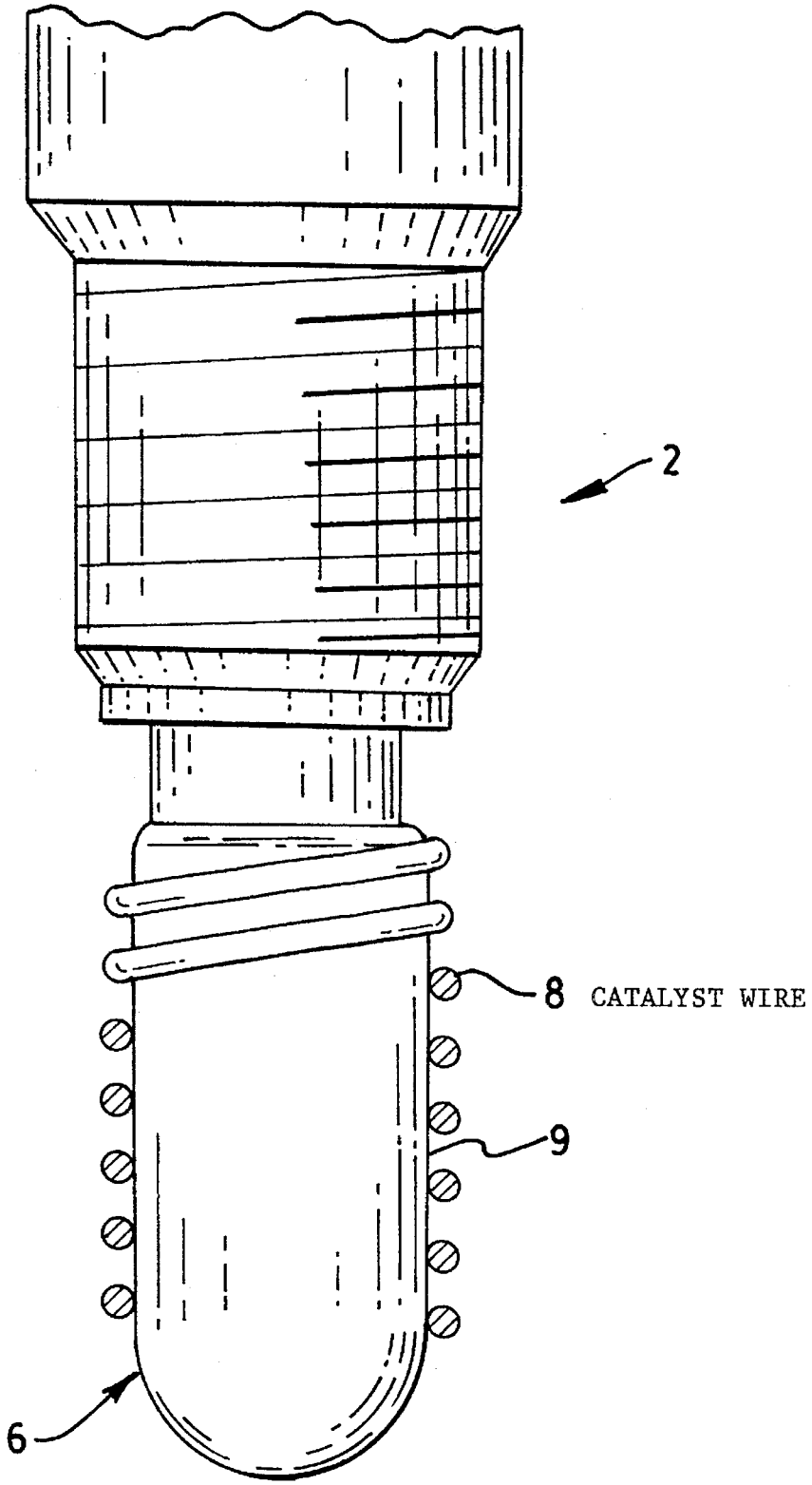
FIG. 2 is an enlarged view of a portion of the glow plug tip.

Referring to FIGS. 1 and 2, a glow plug 2, as is well known in the art, has a heating element 4 and a ceramic silicon nitride tip 6. These well known glow plugs 2 have controls (not shown) for heating the heating element 4, which heat passes outwardly to and through the glow plug tip 6 and into contact with fuel passing into the combustion chamber. During engine operation, the controlling element monitors the temperature of a portion of the glow plug 2 and maintains the temperature within a preselected temperature range.

In the glow plug 2 of this invention, a catalyst 8, preferably catalyst wire, is wrapped about and in intimate contact with the preselected material of the glow plug tip 6. The preselected material of the glow plug tip 6 is preferably silicon nitride, but it should be understood that other materials can be used without departing from this invention.

The catalyst 8 is form of one of gauge, sheath and wire and is formed of one of the platinum group metals, transition metals and a combination thereof. The catalyst wire is free of charge carrying connection to a power source. The catalyst 8 is preferably formed of platinum, rhodium, palladium, or ruthenium, more preferably the wire 8 is formed of platinum.

As better seen in FIG. 2, the catalyst wire has a diameter greater than about 0.003 inches. Diameters smaller than about 0.003 inches are undesirable because of insufficient strength and durability. Preferably, the catalyst wire has a diameter of about 0.008 inches.

The tip 6 of the glow plug 2 has a longitudinal axis and the catalyst 8 is preferably helically wrapped about the longitudinal axis. It is also preferred that the catalyst 8 be in the form of wire and the wire be wrapped with the greatest density at the region exposed to the greatest temperature.

The catalyst wire 8 is preferably of round cross-sectional configuration, although it should be understood that the cross sectional configuration may be of other alternate shapes. Portions of the catalyst wire 8 immediately adjacent said glow plug tip outer surface 9 are in intimate contact with the ceramic silicon nitride tip 6.

The catalyst wire enables the glow plug to operate at much lower temperatures. Therefore, high temperature corrosion of the glow plug tip is reduced and the life of the glow plug is increased.

Industrial Applicability

Helically wrapping of the catalyst avoids the waste of manufacturing time and labor and by providing a crossectionally round wire of relatively large surface area, large surface areas of catalyst are desirably exposed to the atmosphere of the combustion zone.

Other aspects, objects and advantages of this invention can be obtained from a study of the drawings, the disclosure and the appended claims.

We claim:

1. A glow plug having a heating element and a tip, said tip being formed of a preselected material having an outer surface, comprising:

a catalyst wrapped about and in intimate contact with said preselected material of the glow plug tip, said catalyst having a shape in the form of a wire, said wire having a cross-sectional area in the range of about $10\times10^{-6}$ in$^2$ to about $300\times10^{-6}$ in$^2$, and being formed of one of platinum group metals, transition metals or a combination thereof, and said catalyst being free of charge carrying connection to a power source.

2. A glow plug, as set forth in claim 1, wherein said catalyst has a shape in the form of a wire and has a diameter of about 0.008 inches.

3. A glow plug, as set forth in claim 1, wherein said glow plug tip has a longitudinal axis and said catalyst is helically wrapped about the longitudinal axis.

4. A glow plug, as set forth in claim 1, wherein said catalyst has a shape in the form of a wire and is of round cross sectional configuration.

5. A glow plug, as set forth in claim 1, wherein the catalyst is platinum.

* * * * *

UNITED STATES PATENT AND TRADEMARK OFFICE

CERTIFICATE OF CORRECTION

PATENT NO. : 5,580,476

DATED : December 3, 1996

INVENTOR(S) : Chuong Q. Dam et al.

It is certified that error appears in the above-identified patent and that said Letters Patent is hereby corrected as shown below:

On the title page: Item [54] and Column 1, lines 1 and 2

Please correct the title of the Invention to read as follows:

" COMBUSTION CATALYST WIRE WRAPPED ON A GLOW PLUG"

Signed and Sealed this

Sixteenth Day of September, 1997

*Attest:*

*Attesting Officer*

BRUCE LEHMAN

*Commissioner of Patents and Trademarks*